US009106012B2

(12) United States Patent
Gross, III

(10) Patent No.: US 9,106,012 B2
(45) Date of Patent: Aug. 11, 2015

(54) ANTIROTATION COUPLING FOR CONNECTOR

(75) Inventor: Russell Frederick Gross, III, Riverside, CA (US)

(73) Assignee: ITT MANUFACTURING ENTERPRISES, INC., Wilmington, DE (US)

( * ) Notice: Subject to any disclaimer, the term of this patent is extended or adjusted under 35 U.S.C. 154(b) by 1981 days.

(21) Appl. No.: 12/156,356

(22) Filed: May 30, 2008

(65) Prior Publication Data

US 2009/0297256 A1 Dec. 3, 2009

(51) Int. Cl.
*H01R 13/62* (2006.01)
*H01R 13/622* (2006.01)

(52) U.S. Cl.
CPC ..... *H01R 13/622* (2013.01); *Y10T 403/299* (2015.01); *Y10T 403/32434* (2015.01)

(58) Field of Classification Search
USPC ..... 403/342, 348, 349, 350; 439/314, 316, 439/317, 318; 285/360, 361, 362, 396, 401, 285/402
See application file for complete search history.

(56) References Cited

U.S. PATENT DOCUMENTS

| | | | | | |
|---|---|---|---|---|---|
| 2,195,492 | A | * | 4/1940 | McDonald | 285/362 |
| 3,334,661 | A | * | 8/1967 | Milette | 285/362 |
| 3,669,472 | A | | 6/1972 | Nadsady | |
| 3,917,373 | A | | 11/1975 | Peterson | |
| 4,030,798 | A | * | 6/1977 | Paoli | 439/321 |
| 4,359,254 | A | | 11/1982 | Gallusser et al. | |
| 4,536,048 | A | | 8/1985 | Schildkraut et al. | |
| 4,548,458 | A | | 10/1985 | Gallusser et al. | |
| 4,808,117 | A | | 2/1989 | Gale et al. | |
| 4,878,695 | A | * | 11/1989 | Whitham | 403/348 |
| 4,928,202 | A | | 5/1990 | Gale et al. | |
| 5,200,575 | A | | 4/1993 | Sheehan | |
| 5,399,096 | A | | 3/1995 | Quillet et al. | |
| 5,702,263 | A | | 12/1997 | Baumann et al. | |
| 5,786,976 | A | | 7/1998 | Field | |
| 5,897,277 | A | * | 4/1999 | Barre et al. | 411/331 |
| 5,957,716 | A | | 9/1999 | Buckley et al. | |
| 5,959,828 | A | | 9/1999 | Lewis et al. | |
| 6,086,400 | A | | 7/2000 | Fowler | |
| 6,123,563 | A | * | 9/2000 | Johnson et al. | 439/321 |
| 6,135,800 | A | | 10/2000 | Majors | |
| 6,152,753 | A | * | 11/2000 | Johnson et al. | 439/312 |
| 6,183,293 | B1 | | 2/2001 | Kieninger | |

OTHER PUBLICATIONS

International Preliminary Report on Patentability for PCT/US2007/069277, dated Nov. 18, 2008—7 pages.

* cited by examiner

*Primary Examiner* — Michael P Ferguson
(74) *Attorney, Agent, or Firm* — Shook, Hardy & Bacon L.L.P.

(57) ABSTRACT

A mechanism (20) for connecting the coupling nut (14) and barrel (12) of an electrical or optical connector to resist but not prevent their relative rotation, includes a clicker ring (22) that has forward-projecting teeth (36) and that fits into a circular recess (32) at the rear of the coupling nut to engage rearward-projecting nut teeth (34). The clicker ring also has slots (40) that receive radially-outward projections (42) on the barrel, to prevent clicker ring turning.

4 Claims, 5 Drawing Sheets

ANTIROTATION COUPLING FOR CONNECTOR

BACKGROUND OF THE INVENTION

One type of signal connector, which may be an electrical or optical connector, includes a barrel that holds a body with passages that receive electrical contacts or optical termini. A coupling nut that lies around the barrel, can be turned to threadably connect the barrel to a mating connector. A mechanism is used to allow the coupling nut to turn in a direction to mate, while resisting turning in the opposite direction to unmate. Present mechanisms include a radial gear ratchet which takes up considerable radial space. Sufficient radial space can be provided without increasing the overall diameter of the connector by using thinner coupling nut walls, except that the walls then are too thin when the coupling nut is formed of plastic. A mechanism that allowed the coupling nut to turn more freely in mating than unmating and which took up little radial space would be of value.

SUMMARY OF THE INVENTION

In accordance with one embodiment of the present invention, a connector is provided of the type that has includes a coupling nut that surrounds a barrel, which allows nut turning in a direction to mate but resists turning in the opposite direction to unmate, and that takes up little radial space. The coupling nut is provided with a ring of nut teeth at its rear end, and a clicker ring is provided that has a ring of clicker teeth engaged with the nut teeth. The clicker ring is prevented from rotating with respect to the barrel, and is spring biased forward toward the nut teeth. At least one of the sets of teeth such as the clicker teeth, are formed to offer little resistance to rotation of the coupling nut in a mating direction while offering a much greater resistance to rotation in the opposite unmating direction.

In one connector, the rear end of the coupling nut has a circular recess which receives the clicker ring, with the coupling nut teeth lying in the recess and projecting rearward. The barrel has a circular outer surface with anti-rotation tabs, and the clicker ring has slots on the inner surface of the ring that receive the anti-rotation tabs to prevent clicker ring rotation. A spring washer lies behind the clicker ring to bias it forward, and a retaining washer lies behind the spring washer to retain it in the connector. The barrel has retaining tabs projecting from its outer surface, and the retaining washer has slots that allow it to first pass forward of the retaining slots, to then be turned several degrees, and to then move slightly rearward so recesses in the rear of the retaining washer receive the retaining tabs.

The novel features of the invention are set forth with particularity in the appended claims. The invention will be best understood from the following description when read in conjunction with the accompanying drawings.

DESCRIPTION OF THE INVENTION

Figure 1:
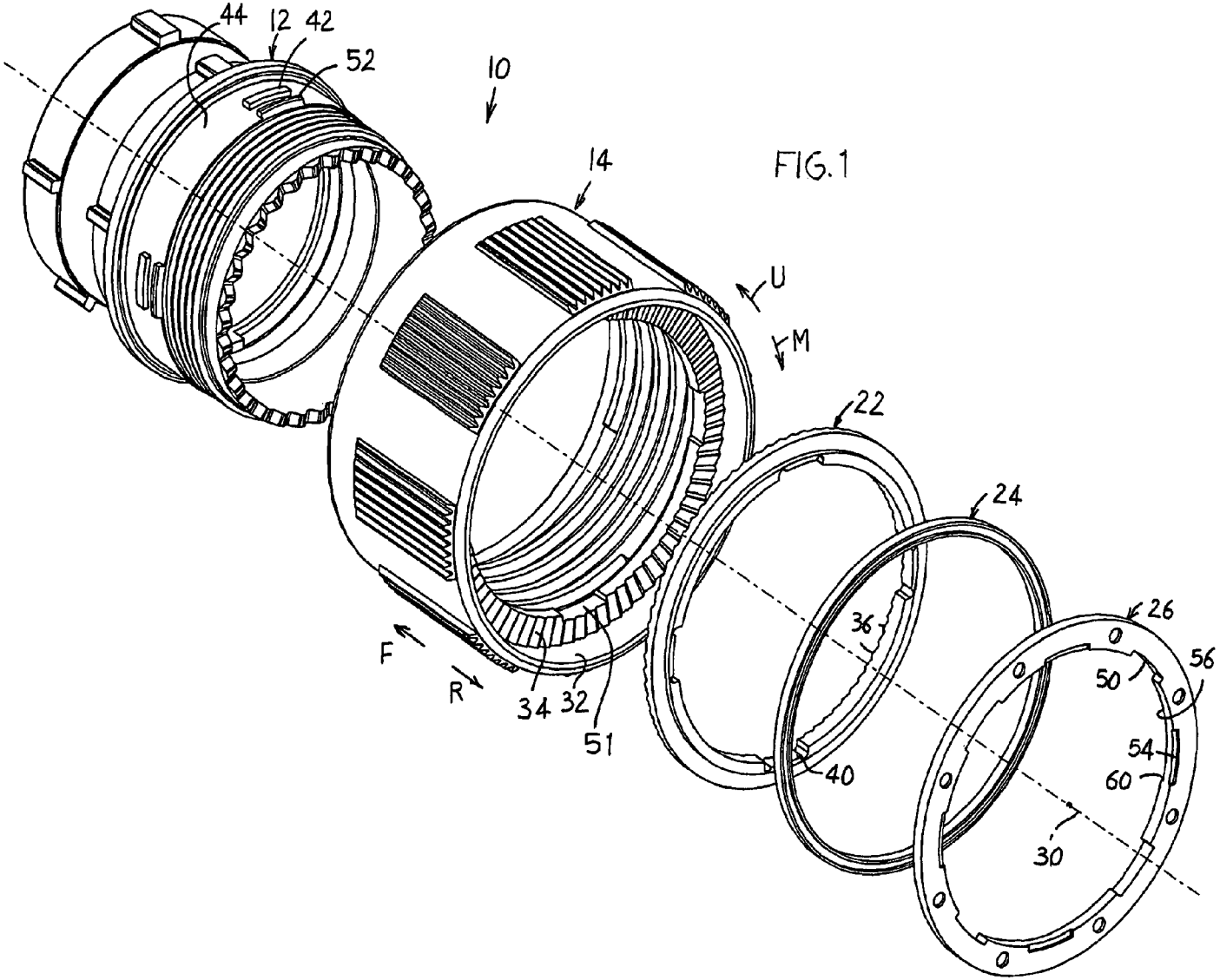
FIG. 1 is an exploded rear isometric view of a connector of a first embodiment of the invention.

FIG. 1 shows an electrical connector 10 which includes a barrel 12 that is designed to hold a body with passages that hold electrical contacts or optical termini. A coupling nut 14 is rotatable around the barrel and is used to threadably engage a mating connector. The barrel and coupling nut are each preferably molded of plastic. The connector also includes a mechanism 20 that allows the coupling nut to easily turn in one direction M to mate the connector with another connector, and to turn with high resistance in an opposite unmating direction U to unmate from such other connector. The mechanism 20 includes a clicker ring 22, a spring washer 24, and a retainer washer 26. The barrel, nut, and parts of the mechanism are all centered on the axis 30 of the connector. It is desirable that the coupling nut have no more than a predetermined outside diameter to fit into predetermined spaces designed to hold it.

The coupling nut is formed with a circular recess 32 that is centered on the axis 30 and that lies in the inside of its rear R end. The coupling nut is formed with a circle of primarily rearward-projecting (rather than primarily forward projecting) nut teeth 34 in the recess. The clicker ring 22 has partially forwardly F projecting clicker teeth 36 on its forward face, that are intended to engage the nut teeth. The only partially forward and only partially rearward projecting teeth are sometimes referred to herein as forward projecting and rearward projecting teeth. The clicker ring is spring biased forwardly by the spring washer 24 to assure that the clicker teeth engage and disengage from the nut teeth as the coupling nut is turned. The clicker ring moves slightly forward and rearward as it turns and repeatedly engages the nut teeth. One type of spring washer is a wave washer.

Figure 7:
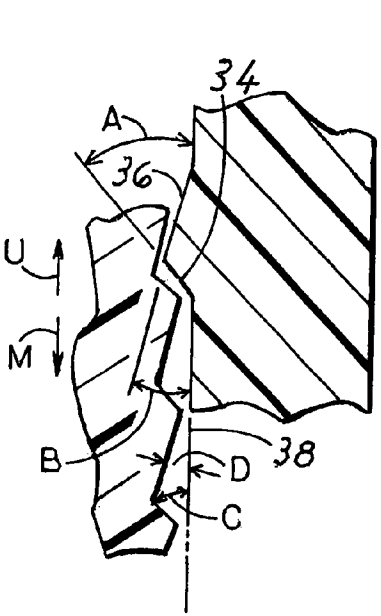
FIG. 7 is an enlarged view of area 7-7 of FIG. 6, and showing a portion of the coupling nut teeth.
Figure 10:
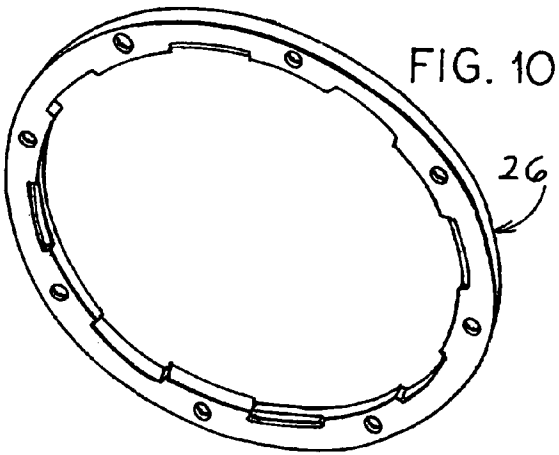
FIG. 10 is a rear isometric view of the retainer washer of FIG. 9.
Figure 6:
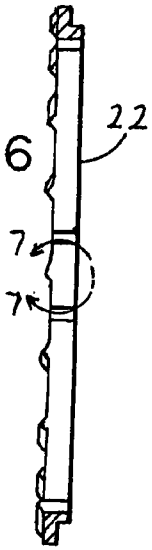
FIG. 6 is a side elevation view of the clicker ring of FIG. 5.

FIG. 7 shows the nut teeth 34 and clicker teeth 36, showing that they are angled to allow the coupling nut to easily turn in the mating direction M and to provide higher resistance to turning in the opposite unmating direction U. For the connector of FIG. 7, the angles A and B from a circumferential direction 38 of the clicker teeth opposite sides are respectively 40° and 17°. The angles C and D of the nut teeth are respectively 60° and 15°. The resistance to turning also depends upon the spring force pushing the clicker ring forward. The torque required to rotate the coupling nut in one direction U is at least 1.5 times the torque required for rotating the coupling nut in the opposite direction M. The required torque for rotation in the unmating direction is on the order of magnitude of one foot-pound.

The clicker ring is prevented from rotating with the coupling nut by engagement of clicker slots 40 (FIG. 1) with anti-rotation tabs 42 on the barrel 12, when the barrel has been projected rearward R through the coupling nut. The anti-rotation tabs 42 project radially outward (with respect to the axis 30) from a circular surface 44 of the barrel. The surface 44 centers the circular inside surface of the clicker ring on the barrel. When the connector is fully assembled, the barrel has been moved sufficiently rearward to move its anti-rotation tabs 42 into the clicker slots.

The retainer washer 26 (FIG. 1) keeps the spring washer pressed against the clicker ring, and prevents the parts of the mechanism from falling out of the connector. The retainer washer 26 has through slots 50, and the retainer washer can be moved forwardly until retaining tabs 52 that project radially out from the coupling nut circular surface 44, pass through the retainer washer through slots 50. After the retainer washer has passed forward of the retaining tabs 52, the retainer washer 26 is turned in the direction U until recesses 54 in the retaining washer 26 receive the retaining tabs.

Figure 9:
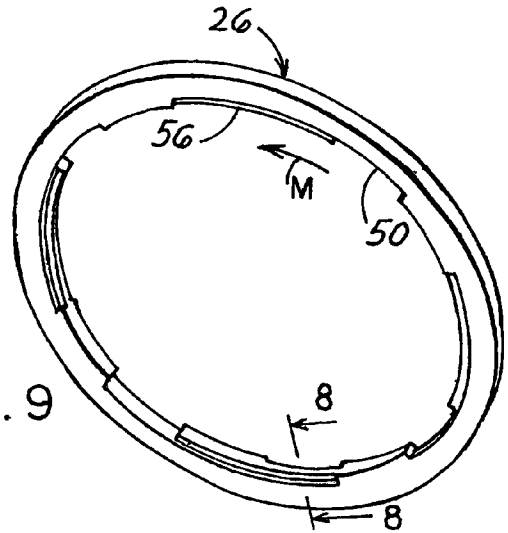
FIG. 9 is a front isometric view of the retainer washer of FIG. 1.
Figure 5:
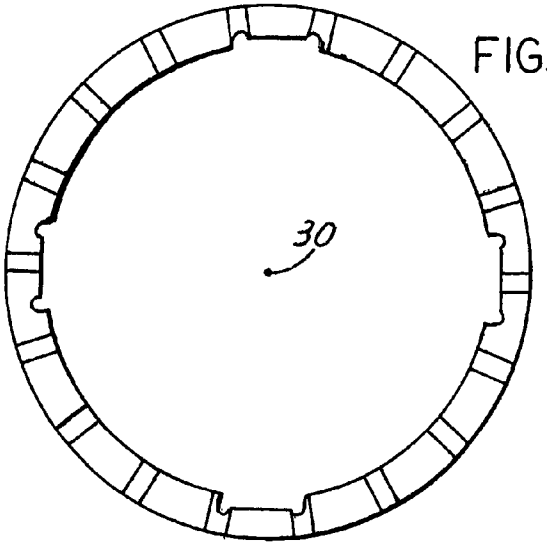
FIG. 5 is a front elevation view of the clicker ring of FIG. 1.
Figure 8:
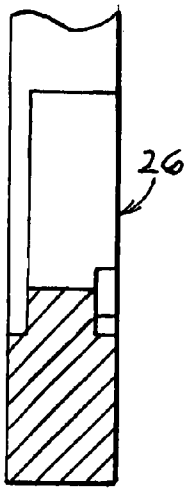
FIG. 8 is an enlarged sectional view of a portion of the retainer washer of FIG. 9.

The retaining tabs 52 (FIG. 1) and the anti-rotation tabs 42 are aligned. The retainer washer 26 has guideways 56 (FIG. 9) that extend in the direction M from each through slot 50. A technician, after pressing the retaining washer (26, FIG. 1) forward F, can rotate the washer in the direction U until he/she feels that a stop 60 on the retaining washer has abutted an end of an anti-rotation tab 42. Then the technician can allow the retaining washer to move rearward under spring washer biasing so the recesses 54 in the retaining washer receives the retaining tabs 52. The clicker ring, washer 26, and coupling nut 14 of FIG. 1 each have four through slots or recesses 40, 50, 51. The barrel 14 has four tabs 42, 52 of each type. It is possible to provide only one of such slots, recesses and tabs, but at least two of each are preferred.

Figure 3:
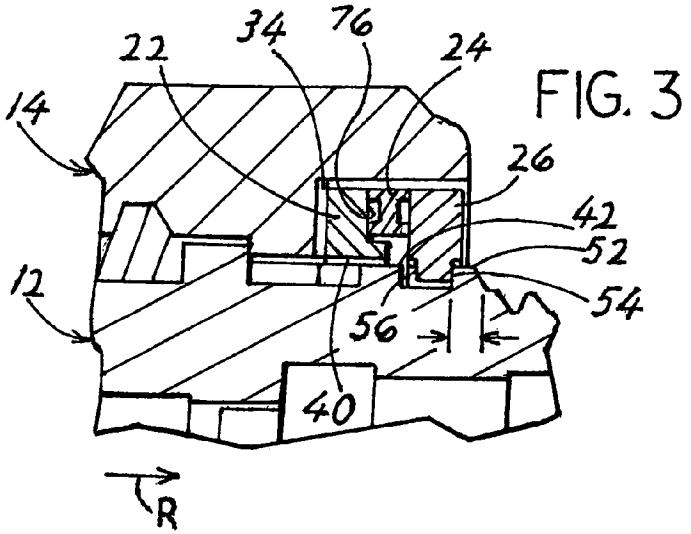
FIG. 3 is an enlarged view of area 3-3 of FIG. 2.
Figure 4:
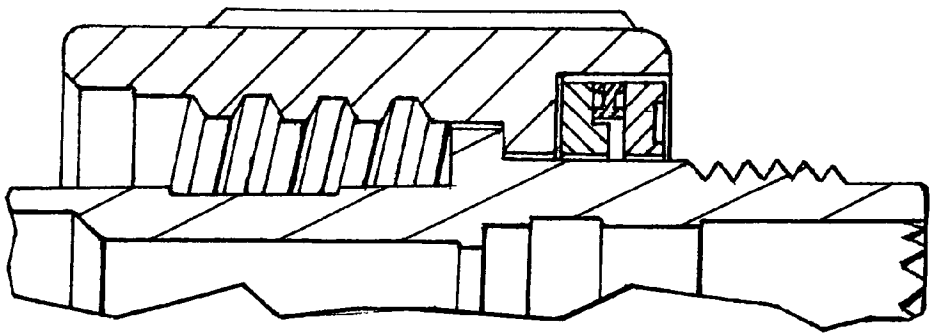
FIG. 4 is a view similar to FIG. 3, but taken at a different location around the connector.
Figure 2:
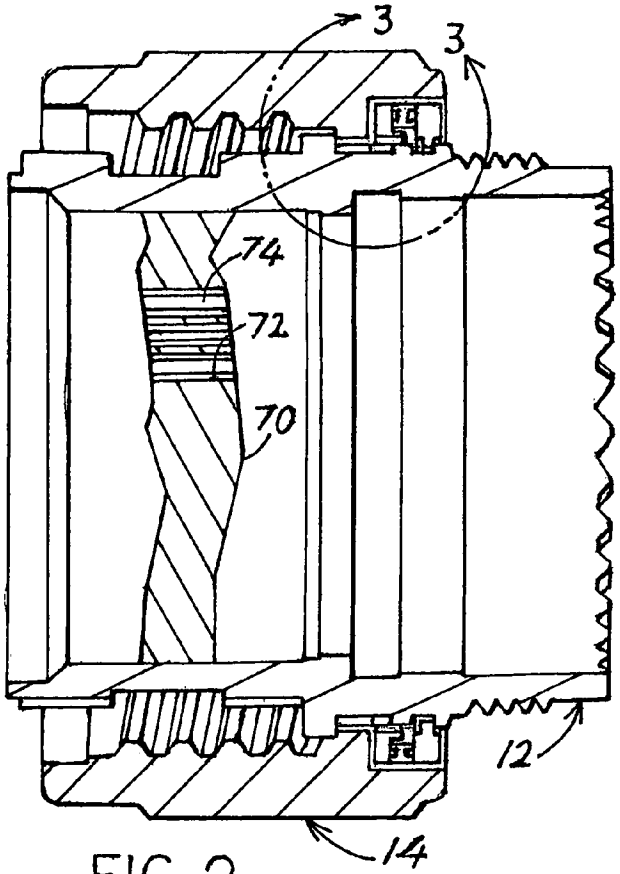
FIG. 2 is a sectional view of the assembled connector of FIG. 1.

FIG. 2 shows a dielectric body 70 in the barrel 12 with passages 72 for holding contacts 74 (or termini). FIG. 3 shows the retainer washer 26 with a recess 54 engaging a retaining tab 52, after a guideway 56 on the retaining washer disengaged from an anti-rotation tab 42. A slot 40 of the clicker ring receives the anti-rotation tab 42. FIG. 3 shows that the spring washer 24 lies in a cutout 76 in the rear of the clicker, with the radially inner part of the clicker being wider to form the slots 40.

Figure 11:
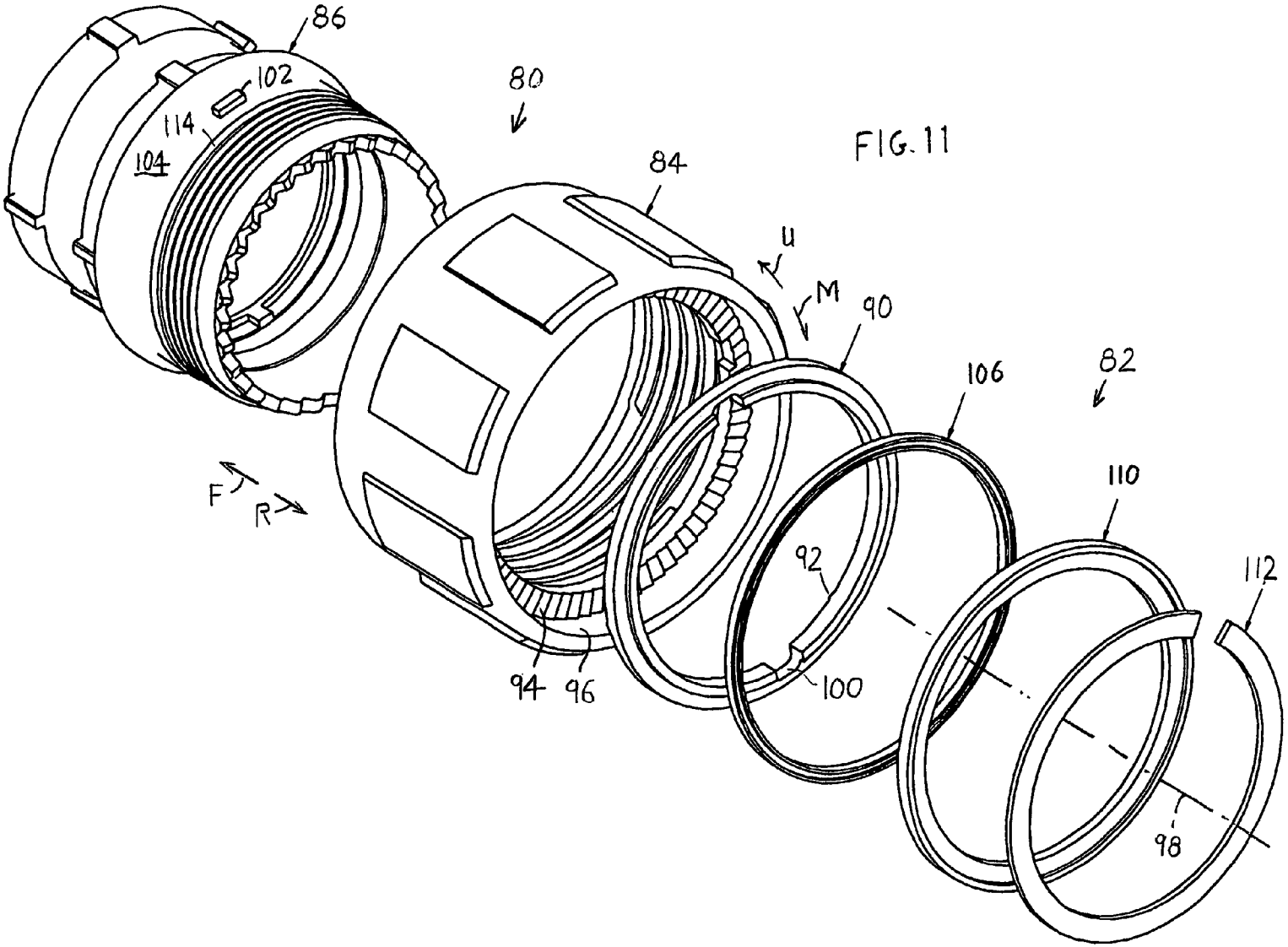
FIG. 11 is an exploded rear isometric view of a connector of another embodiment of the invention.
Figure 13:
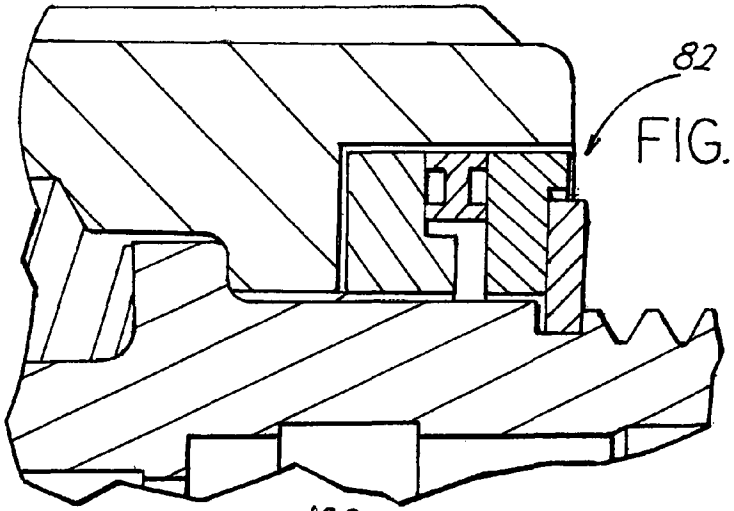
FIG. 13 is a view similar to that of FIG. 12, but taken at a different location of the clicker ring.

FIG. 11 shows another electrical connector 80 with a different mechanism 82 that allows the coupling nut 84 to turn easily in a mating direction M relative to a barrel 86 and to turn in the unmating direction U only when a higher torque is applied. The mechanism includes a clicker ring 90 with clicker teeth 92 that engage nut teeth 94 formed in a circular recess 96 at the rear end of the coupling nut. The connector has an axis 98, and the clicker ring 90 has a pair of slots 100 that receive a pair of radially outward (with respect to the axis) projections or tabs 102 on the circular surface 104 of the barrel to prevent clicker ring rotation. A spring washer 106, such as a wave spring biases the clicker ring forward F. A backup washer 110 presses forward against the spring washer, and a retaining washer 112 backs up the backup washer. The retaining washer shown is sometimes referred to as a snap ring, which can be expanded in diameter and moved around the barrel 86 until the retaining ring contracts and lies in a slot 114 in the barrel.

When the coupling nut 14 (FIG. 3) is turned to uncouple it from a mating connector, the coupling nut 14 moves rearward R and abuts the clicker ring 22. The clicker ring pushes rearward against the spring washer 24, which pushes against the retaining washer 26, which pushes against the retaining tab 52 to push the barrel 12 rearward. The pushing forces pass from the nut teeth 34 through the clicker teeth, or ramps 36 (FIG. 7), which can produce higher than desired uncoupling pressure on the clicker teeth.

Figure 15:
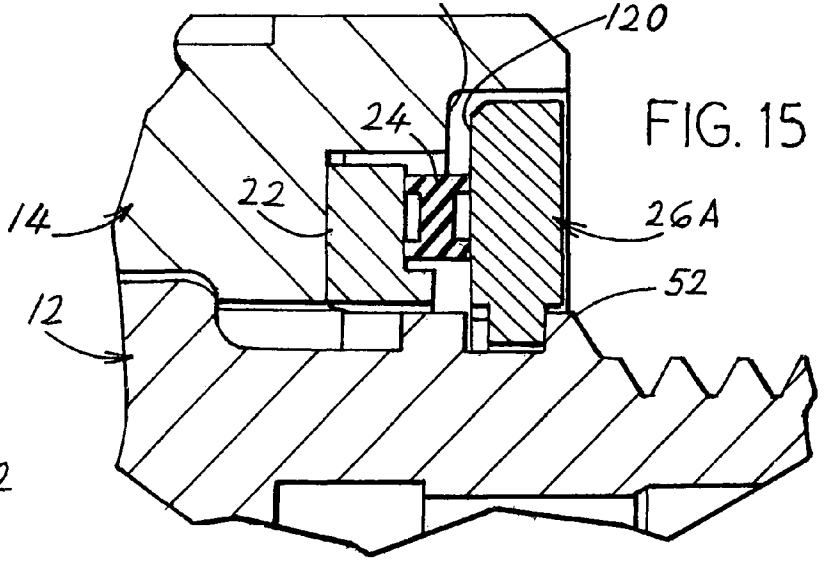
FIG. 15 is a sectional view of an area similar to that of FIG. 3, but for a modified retainer washer.
Figure 12:
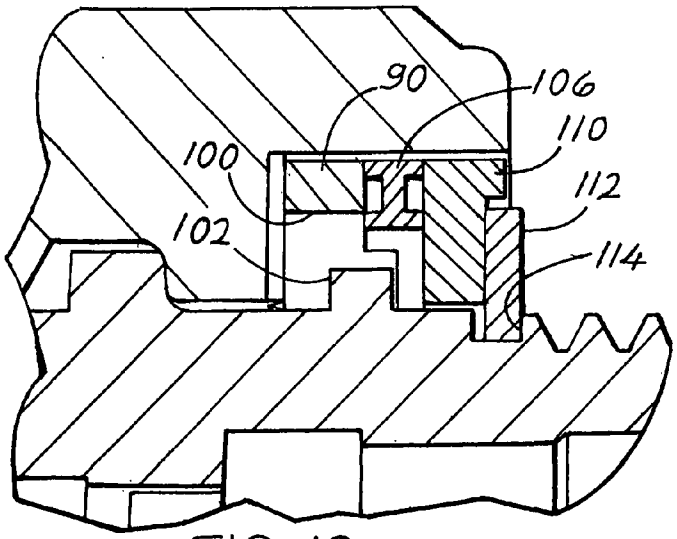
FIG. 12 is a sectional view of the assembled connector of FIG. 11.
Figure 14:
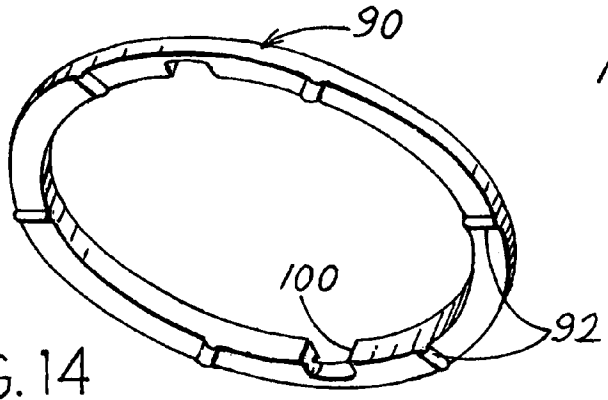
FIG. 14 is a front isometric view of the clicker ring of FIG. 11.

FIG. 15 shows a variation of FIG. 3, where the retainer washer 26A has an increased outer diameter. This forms the retainer washer with a nut-engaging radially outer part 120 that lies closely rearward of a rear shoulder 122 on the coupling nut 14. When the nut 14 is turned to uncouple, and it pushes the clicker ring 22 rearward and begins to compress the spring washer 24, the nut shoulder 122 engages the retainer washer 26A which engages the retaining tabs 52 on the barrel to directly move the barrel 12 rearward.

Thus, the invention provides a mechanism for connecting a coupling nut and barrel of a connector to control the rotation of the coupling nut, as to control the torque required to rotate the coupling nut in each direction, wherein the mechanism can fit in a connector without adding to its diameter or requiring a thinning of nut or barrel walls. The coupling nut is modified to add a plurality of nut teeth, and a clicker ring is added that has clicker teeth that engage the nut teeth to control coupling nut rotation. The coupling can be formed with a circular recess in its rear end, and with the nut teeth projecting rearwardly from the front end of the recess. The clicker ring fits into the recess to engage its teeth with the nut teeth. The clicker ring is prevented from rotating relative to the barrel by slots in the radially inner surface of the clicker ring that engage radially outward projections or tabs on the barrel. The clicker ring is biased forward by a spring washer, and the spring washer is retained in place by a retainer washer. One form of retainer washer has through slots that pass forwardly across retainer tabs on the barrel, with the retainer washer then turned so a retainer washer recess receives the retainer tabs to prevent any further rearward movement of the retainer washer.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector which includes a barrel (12) that has an axis (30) extending in forward and rearward directions, and a coupling nut (14) that lies around and is rotatable around the barrel, wherein:

said coupling nut has a ring of nut teeth (34); and including:

a clicker ring (22) that has a plurality of rigid clicker teeth (36) engaged with said nut teeth to resist rotation of the coupling nut;

of said barrel and said clicker ring, one has a plurality of radial projections (42) and the other has a plurality of slots (40) that receive said projections and prevent clicker ring rotation despite slight axial movement of the clicker ring as said nut and clicker teeth move across one another, and said barrel (12) projects through a majority of the axial length of said nut (14) to engage said clicker ring (22);

a spring (24) that biases said clicker ring forward to keep its clicker teeth engaged with said nut teeth of said coupling nut.

2. The connector described in claim 1 wherein:

said coupling nut has a rear end that forms a circular recess (32) therein with said ring of nut teeth projecting rearwardly from a front end of said recess;

said clicker ring lies in said circular recess with said clicker teeth (36) engaging said nut teeth (34).

3. A connector that has an axis (30) that extends in forward and rearward directions, a barrel (12), a coupling nut (14) that lies around said barrel and is rotatable about said axis relative to said barrel, and a mechanism (20) that resists free rotation of said coupling nut around said barrel, wherein:

said coupling nut has a rear end that forms a circular nut recess (32) therein and a ring of rearward-projecting nut teeth (34) in said nut recess;

said mechanism includes a clicker ring (22) that lies in said nut recess, said clicker ring having a plurality of forward projecting clicker teeth (36) that repeatedly engage and disengage said nut teeth when said coupling nut is turned relative to said clicker ring, said mechanism also including a spring washer (24) that lies rearward of said clicker ring and that biases said clicker ring forward and a retainer washer (26) that limits rearward movement of said spring washer and that is biased rearward by said spring washer;

said barrel has a radially outward projecting retaining tab (52), and said retainer washer has a slot (50) that allows said retainer washer to pass forward of said retaining tab, to then be turned about said axis, and to then move rearward against said retaining tab;

said retainer washer has a rear face with a recess (54) therein that receives said retaining tab (52) when the retainer washer moves rearward against said retaining tab.

4. A connector which includes a barrel (12) that has an axis extending in forward and rearward directions, and a coupling nut (14) that lies around and is rotatable around the barrel, wherein:

said coupling nut has a ring of nut teeth (34); and including a clicker ring (22) that is fixable in rotatable position on said barrel and that has a plurality of clicker teeth (36) engaged with said nut teeth to resist rotation of the coupling nut;

means (24) for biasing said clicker ring forward to keep its clicker teeth engaged with said nut teeth of said barrel;

said means for biasing said clicker ring forward includes a spring washer (24) and a retainer washer (26) that pushes said spring washer forward;

said barrel has an outer surface with a plurality of circumferentially-spaced radially outward projecting retainer tabs, said retainer washer has a plurality of slots (50), and said retainer washer is axially moveable forward of said projections by said projections passing through said slots;

said retainer washer also having recesses (54) that receive said retainer projections when said retainer washer is turned and then moved rearward after passing forward of said projections to prevent said retainer washer from moving further rearward and to prevent said retainer washer from turning.

* * * * *